United States Patent [19]

Sanders et al.

[11] Patent Number: 4,490,049

[45] Date of Patent: Dec. 25, 1984

[54] MIXING ARRANGEMENT

[75] Inventors: John T. Sanders; Donald L. Stewart, both of Houston, Tex.

[73] Assignee: Cron Chemical Corporation, Houston, Tex.

[21] Appl. No.: 500,580

[22] Filed: Jun. 2, 1983

[51] Int. Cl.[3] ..... B01F 5/12; B01F 15/02

[52] U.S. Cl. ..... 366/134; 366/164; 366/177; 366/190; 366/196; 366/265; 366/279; 366/343; 415/102

[58] Field of Search ..... 366/131, 132, 134, 136, 366/137, 150, 165, 163, 164, 172, 173, 176, 177, 184, 190, 194–196, 241, 262–265, 270, 279, 315, 316, 342, 343; 415/97, 102; 261/83, 84

[56] References Cited

U.S. PATENT DOCUMENTS

| | | | |
|---|---|---|---|
| 1,084,210 | 1/1914 | Howard | 366/164 |
| 1,102,696 | 7/1914 | Shiner | 366/177 |
| 2,190,896 | 2/1940 | Underwood | 366/265 |
| 2,549,169 | 4/1951 | Christy | 366/134 |
| 3,222,036 | 12/1965 | Franz et al. | 366/190 |
| 3,231,176 | 1/1966 | Bowen | 415/102 |
| 3,246,605 | 4/1966 | Fisher | 415/102 |
| 3,480,262 | 11/1969 | Himel | 366/279 X |
| 4,208,134 | 6/1980 | Whittle | 366/196 X |
| 4,448,539 | 5/1984 | Burgert | 366/134 X |

*Primary Examiner*—Timothy F. Simone
*Attorney, Agent, or Firm*—Jack W. Hayden

[57] ABSTRACT

A longitudinally extending housing with end closures forms a closed mixing chamber within the housing. A mixer that has a fluid material inlet at each end thereof with longitudinally spaced, opposed ends forming fluid material outlets and a central peripheral discharge from the mixer between the end outlets is supported on a rotatable shaft that extends through one of the end closures to position the mixer in the mixing chamber. Housing inlet means comprising a pair of conduits communicate fluid to the closed mixing chamber for discharging it thereinto adjacent, but spaced from the end fluid inlets of the mixer, and housing outlet means is aligned with the mixer to receive the central discharge therefrom. The diameter of the mixer is about one-half the diameter of the closed mixing chamber, and the length of the mixer is about one-third the longitudinal extent of the closed mixing chamber. The mixer is positioned substantially equidistant from the sides and ends of the mixing chamber.

10 Claims, 2 Drawing Figures

MIXING ARRANGEMENT

SUMMARY OF THE INVENTION

Mixers having end fluid inlets and spaced, opposed fluid outlets with a central discharge therebetween are well known and have been employed in open top tanks or containers for mixing powders with liquids, liquids with liquids or gases with liquids. However, mixing arrangements in open top containers form vortexes in the containers, thus injecting air into the fluids or liquid materials being mixed which in many instances is extremely undesirable. Heretofore, various efforts have been made to overcome such problem by providing baffles in the tank or to shift the mixing arrangement off center to attempt to avoid the vortex formation. Further, such mixing arrangements cause heat sinks and a subsequent loss of energy.

A primary object of the present invention is to provide a mixing arrangement wherein the fluid materials being mixed are pumped or pressured into and out of the mixing chamber so that the liquid materials are maintained under pressure at all times, eliminating the formation of a vortex within the mixing chamber and the resultant introduction of air into the mixed liquid.

Yet a further object of the present invention is to provide a mixing arrangement wherein the fluid materials to be mixed are introduced into a mixing chamber adjacent each inlet end of a rotatable mixer which has a central discharge therein so that the material is conducted to each end of the mixer and then discharged from the center thereof, with the outlet of the mixing chamber being aligned with the central discharge of the mixer for directly receiving the mixed fluid materials upon discharge from the mixer under pressure.

Still another object of the invention is to provide a mixing arrangement wherein the fluid materials to be mixed are introduced into a mixing chamber adjacent each inlet end of a rotatable mixer which has a central discharge therein so that the material is conducted to each end of the mixer and then discharged from the center thereof, with the outlet of the mixing chamber being aligned with the central discharge of the mixer for directly receiving the mixed fluid materials upon discharge from the mixer under pressure and wherein the diameter of the mixer is about one-half the diameter of the mixing chamber and the length of the mixer is about one-third the length of the mixing chamber with the mixer positioned substantially equidistant from the sides and ends of the mixing chamber.

Other objects and advantages of the present invention will become more readily apparent from a consideration of the following drawing and description.

DESCRIPTION OF PREFERRED EMBODIMENT

Figure 1:
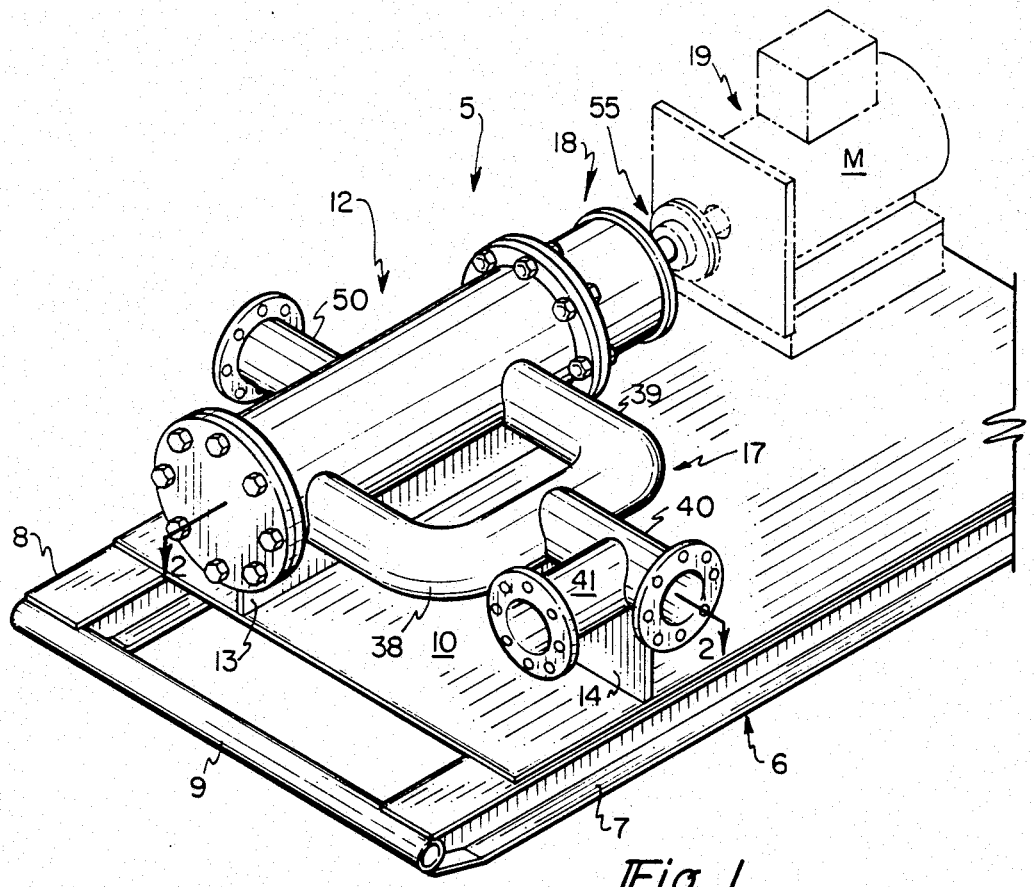
FIG. 1 is a perspective view illustrating a preferred arrangement of the present invention.

Attention is first directed to FIG. 1 of the drawings wherein the mixing arrangement of the present invention is referred to generally by the numeral 5 and is shown as being supported on a skid referred to generally at 6 for transport. The skid can be of any suitable configuration and is shown as including longitudinally extending, horizontal runners 7 and 8 formed of any suitable means such as I beams or the like which are secured together in lateral spaced relation by any suitable means such as the laterally extending tubular or brace members 9. A support surface 10 for the present invention extends laterally and horizontally between the runners 7 and 8 and is secured thereto by any suitable means.

The housing means 12 of the present invention is supported by any suitable means such as the vertically extending brace 13 secured to and projecting upwardly from the support surface 10, the brace 13 extending longitudinally of the housing means 12 as shown in FIG. 1. Similarly, the housing inlet conduit means referred to generally at 17 is supported on the vertically extending brace 14 secured to and extending upwardly from the support surface 10 as shown in FIG. 1. The other components 18 and 19 may be similarly supported on the surface 10.

Figure 2:
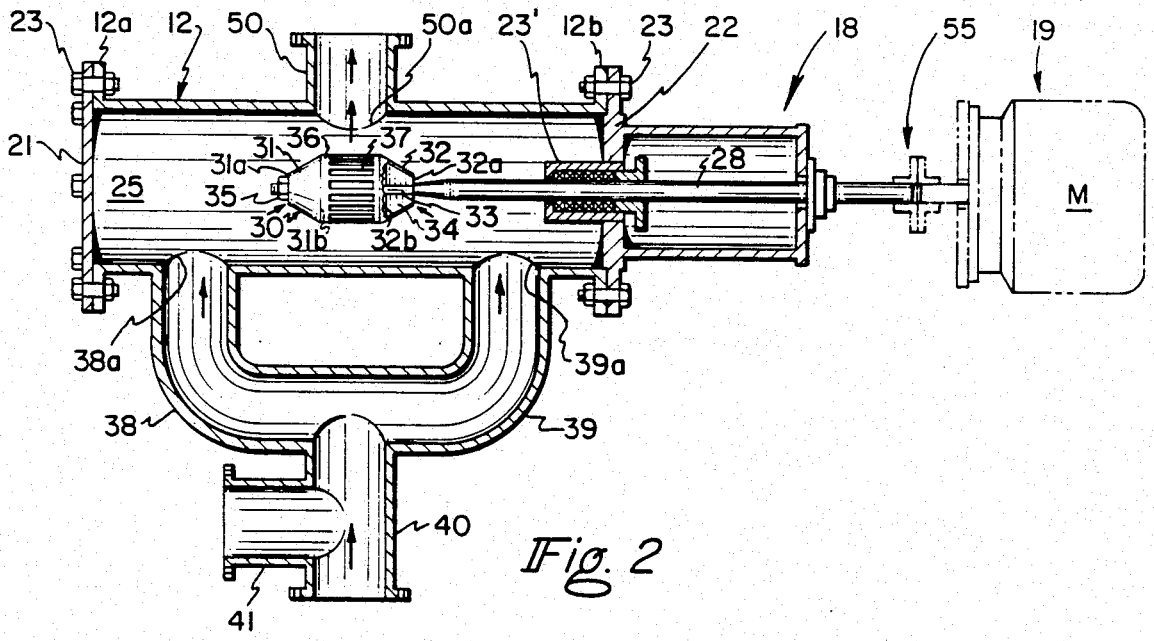
FIG. 2 is a sectional view illustrating the arrangement of FIG. 1.

In FIG. 2, the housing means 12 is again referred to and in its preferred form is a cylindrical configuration. Each end of the housing 12 is provided with an annular projection **12*a* and 12*b* for receiving the end closures 21 and 22 which may be secured to the projections 12*a* and 12*b* by means of the nut and bolt arrangement referred to at 23**.

This forms a closed mixing chamber 25 within the housing means 12 for mixing a mixture of liquids or mixture of liquids and powders or other materials constituting the fluid materials as described in the present invention. The end closure 22 also includes a centrally located combination packing gland and bearing means referred to generally at 23' for rotatably receiving and supporting therethrough the shaft 28 which is provided with the mixer 30 thereon at one end for positioning it in the closed mixing chamber 25. The mixer 30 includes a pair of spaced frusto-conical members 31 and 32 each of which has a central hub 33 with circumferentially spaced vanes 34 connected between the hub 33 and its respective frusto-conical member 31 or 32. The hubs 33 support each frusto-conical member 31, 32 on the shaft 28, and a nut 35 is threadedly engaged on the end of the shaft 28 and locks the mixer 30 with the shaft 28 for rotation therewith. Each of the frusto-conical members 31, 32 has full open end portions with each small end **31*a* and 32*a* defining an end fluid inlet at each end of the mixer 30 and the larger end 31*b*, 32*b* providing an outlet end for the fluid materials which enters each inlet end 31*a*, 32*a*. A cylindrical member 36 is secured to and extends between the larger discharge or outlet ends 31*b*, 32*b* with openings 37 in the periphery thereof between the members 31, 32 to define peripheral discharge ports from the mixer means 30. The members 31, 32 and 36 may be welded together and on shaft 28** to form a unitary arrangement.

Housing inlet means communicate pumped or pressured fluid materials comprising a mixture of liquids or a mixture of liquid and solids or a mixture of liquids and gases to the closed mixing chamber 25, such housing inlet means comprising a pair of conduits 38 and 39 to discharge the fluid materials into the mixing chamber 25 through openings **38*a*, 39*a* adjacent, but spaced from, the end fluid inlets 31*a*, 32*a* of each of said pair of frusto-conical members 31, 32. The members 38, 39 are connected to a main inlet conduit 40 and as illustrated in FIG. 1, branch off from each side of the main fluid inlet 40 to provide an inlet means of a generally "Y" configuration. A branch conduit line 41 is shown as being horizontally communicated to the main conduit inlet 40 whereby additional materials may be injected into the liquid stream being conducted through the main conduit 40 for mixing of the materials from the branch line 41 and main conduit 40 when discharged into the closed mixing chamber 25 of the present invention. The inlet nozzle 41 could be mounted on top of 40 so that it extends vertically thereinto. It is preferable that introduction of dry solids be in close proximity to the mixer inlet, that is, ten feet or less. Gas may be injected in 41 or at either end of housing means 12**.

Housing outlet means referred to at 50 are mounted on the housing means 12 and are aligned to receive the discharge from the mixing means 30 of the present invention. More specifically, it will be noted that the outlet opening 50 in housing 12 is aligned with the discharge openings 37 in member 36 so as to receive directly the outlet or discharge from such openings for transporting the outlet directly from the mixing chamber into the outlet conduit 50 and from the closed mixing chamber 25. Thus, the mixer 30 of the present invention in addition to mixing the fluid materials and disintegrating the fluid materials also functions as a pump and creates a pressure in the outlet conduit 50 somewhat in excess of the pressure in inlet conduit 40 which substantially inhibits, if not completely prevents the formation of a vortex within the closed mixing chamber 25 of the present invention.

In the preferred embodiment of the present invention, the housing 12 is adapted to be supported horizontally as illustrated in FIG. 1 of the drawings with suitable driver means designated M which is supported on surface 10 in any suitable manner. The driver shaft is connected with the shaft 28 by any means well known in the art such as referred to generally at 55 for rotation thereof. This enables the present invention to operate the shaft at speeds from 1,750 rpm to 10,000 rpm depending upon the diameter of the mixer 30 in order to achieve peripheral speeds of the mixer in the range of 4,000 to 8,000 feet per minute.

It is to be noted also that the inlet openings 38*a*, 39*a* into the closed mixing chamber 25 are shown in opposed diametric relationship relative to the outlet opening 50*a* on the other side of the housing 12. However, the outlet 50*a* may be 90°, or less from the inlets 38*a*, 39*a*. Further, the inlet openings 38*a*, 39*a* in housing 12 are between and spaced from each of the end closures 21, 22 and the end inlet openings 31*a*, 32*a* of the mixer 30, respectively. The mixer 30 in the embodiment shown is preferably positioned in mixing chamber 25 so that it is equidistant from the sides and ends of the mixing chamber 25. In the embodiment shown, the inlet openings 38*a*, 39*a* are substantially midway between the ends of the mixing chamber 25 and the ends of the mixer 30, and the discharge opening 50*a* is substantially midway of the longitudinal extent of the mixing chamber. However, the length of chamber 25 is only important in that the introduction or inlet of product 25 is at a point beyond the inlets 31*a*, 32*a* of mixer 30.

The particular configuration of the mixing arrangement of the present invention as above described and including the relationship of the inlet openings 38*a*, 39*a* to the outlet openings 50*a*; the relationship of the outlet opening 50*a* in being aligned directly with the outlet openings 37 of the mixer 30 in mixing chamber 25; and the relationship of the diameter of the mixing chamber as a function of the diameter of the mixing head and the product handling capabilities of the mixing head have been found to yield far superior results than that heretofore thought possible with an ordinary mixing arrangement. Further, the mixing arrangement of the present invention creates the desired turbulence in the closed mixing chamber 25 without the introduction of air to the product and sharply reduces the random factor relating to the encounter between the added liquid or solids intensifying or increasing the shearing effect of the solids, the primary liquid and the mixing head as compared with that heretofore encountered in attempting to mix in an open top container with large volume. By way of amplification, the diameter of mixer 30 should be approximately one-half the diameter of mixing chamber 25 and the length of mixer 30 should be approximately one-third the longitudinal extent of the mixing chamber in order to achieve the results of the present invention.

High shear or deagglomeration of solids is most effective for a distance of one to two inches from the mixer 30. If the mixer 30 is placed in a normal tank beyond the area of high shear liquid/solid flow occurs in a laminar state. In the concept of this invention, by placing the mixer 30 in a closed chamber 25, high shear effect is coupled with turbulent flow of the pressured liquid/solids around the circumference of the mixer 30 and chamber 25. The direction of the high shear force and the turbulent flow are at right angles to each other; thus the forces of shear are increased. While the relations of the diameter of the head to the diameter of the chamber must consider the flow of product between the head and the chamber to be in the turbulent range, say six to eight feet per second, if the foregoing general parameters are adhered to, the desired results will be accomplished.

It has also been found that the present mixing arrangement provides a homogeneous product in a wide range of product weights. For example, in the field of mixing drilling fluid additives where product rates currently range from 9 pounds per gallon to 22 pounds per gallon, the present invention provides a homogeneous product with minimum loss of costly additives. If higher weights per gallon than those stated above are desired, the present invention will produce the desired mixing results as long as the final product is a pumpable fluid. Further, the arrangement of the present invention provides a higher efficiency of energy input into the product than the conventional vertical tank batch operation. Thus, energy and resulting heat are efficiently introduced into the product. In those products that might be adversely affected by temperature increases, the pumping rate may be altered or a cooling chamber placed around the mixing chamber.

The foregoing disclosure and description of the invention are illustrative and explanatory thereof, and various changes in the size, shape and materials, as well as in the details of the illustrated construction may be made without departing from the spirit of the invention.

What is claimed is:

1. A mixing arrangement including:

a. longitudinally extending housing means with end closures to form a closed mixing chamber within said housing means;

b. mixing means rotatably supported on shaft means which extends through one of the end closures, said rotatable mixing means including:

1. a pair of spaced frusto-conical members, each of which has a concentric hub with vanes connected between the hub and its respective member whereby each member may be supported on the shaft means;

2. each of said members having full open end portions with the small end defining an end fluid inlet and the larger end an outlet end for the fluid entering the inlet end;

3. a cylindrical member secured to and extending between the larger discharge ends with openings spaced about the periphery thereof to define discharge ports from the mixing means;

c. housing inlet means for communicating fluid materials to said closed mixing chamber in said housing means, said inlet means comprising a pair of conduits to discharge fluid materials into the mixing chamber adjacent the end fluid inlet of each of said pair of frusto-conical members; and d. housing outlet means to receive the discharge from said mixing means and said closed mixing chamber.

2. A mixing arrangement including:

a. longitudinally extending housing means with end closures to form a closed mixing chamber within said housing means;

b. mixing means rotatably supported on shaft means which extends through one of the end closures, said rotatable mixing means including:

1. a pair of spaced frusto-conical members, each of which has a concentric hub with vanes connected between the hub and its respective member whereby each member may be supported on the shaft means;

2. each of said members having full open end portions with the small end defining an end fluid inlet and the larger end an outlet end for the fluid entering the inlet end;

3. a cylindrical member secured to and extending between the larger discharge ends with openings spaced about the periphery thereof to define discharge ports from the mixing means;

c. housing inlet means for communicating fluid materials to said closed mixing chamber in said housing means, said inlet means comprising a pair of conduits to discharge fluid materials into the mixing chamber adjacent the end fluid inlet of each of said pair of frusto-conical members;

d. outlet means in said housing means; and e. pump means in said housing means mixing chamber aligned with said outlet means whereby the discharge from said mixing means is discharged directly therefrom into said outlet means from said closed mixing chamber.

3. The arrangement of claims 1 or 2 wherein said inlet means further comprises an initial inlet fluid materials conductor which connects with said pair of conduits to form a general "Y" configuration.

4. The arrangement of claims 1 or 2 wherein said housing means is supported horizontally, said shaft means extends horizontally through said end closure and said end closure includes packing means and bearing means to seal off said closed mixing chamber and to accommodate rotation of said shaft means, and driver means connected to rotate said horizontally extending shaft means.

5. The arrangement of claims 1 or 2 wherein said outlet means in said housing means is aligned with the discharge openings in said mixing means.

6. The arrangement of claims 1 or 2 wherein said housing means is cylindrical, and wherein said inlet means for said closed mixing chamber are in diametrically opposed relation to said outlet means in said housing means.

7. The arrangement of claims 1 or 2 wherein said mixing means is located substantially midway of the longitudinally extending housing means; said housing inlet means are located between each end closure on said housing means and each end fluid inlet on said mixing means.

8. The arrangement of claims 1 or 2 wherein said mixing means is located substantially midway of the longitudinally extending housing means; said housing inlet means are located between each end closure on said housing means and each end fluid inlet on said mixing means; and said housing outlet means is aligned with the discharge of said mixing means.

9. The arrangement of claims 1 or 2 wherein the outer maximum diameter of the mixer means is about one-half the inner diameter of the closed mixing chamber and wherein the length of the mixer means is about one-third the longitudinal extent of the closed mixing chamber.

10. The arrangement of claims 1 or 2 wherein the outer maximum diameter of the mixer means is about one-half the inner diameter of the closed mixing chamber; wherein the length of the mixer means is about one-third the longitudinal extent of the closed mixing chamber; and wherein the mixer means is positioned substantially equidistant from the sides and ends of the closed mixing chamber.

* * * * *